US006166709A

United States Patent [19]

Goldstein

[11] Patent Number: 6,166,709

[45] Date of Patent: Dec. 26, 2000

[54] BROAD BEAM MONOFILAR HELICAL ANTENNA FOR CIRCULARLY POLARIZED RADIO WAVES

[75] Inventor: M. Larry Goldstein, Palm Bay, Fla.

[73] Assignee: Harris Corporation, Melbourne, Fla.

[21] Appl. No.: 09/352,504

[22] Filed: Jul. 12, 1999

[51] Int. Cl.[7] ..... H01Q 1/36

[52] U.S. Cl. ..... 343/895

[58] Field of Search ..... 343/702, 790, 343/752, 895; H01Q 1/36

[56] References Cited

U.S. PATENT DOCUMENTS

| | | | |
|---|---|---|---|
| 4,169,267 | 9/1979 | Wong et al. | 343/895 |
| 4,935,747 | 6/1990 | Yuichi et al. | 343/895 |
| 5,081,469 | 1/1992 | Bones | 343/895 |
| 5,231,412 | 7/1993 | Eberhardt et al. | 343/790 |
| 5,479,182 | 12/1995 | Sydor | 343/895 |
| 5,612,707 | 3/1997 | Vaughan et al. | 343/895 |
| 5,721,557 | 2/1998 | Wheeler et al. | 343/895 |
| 5,754,146 | 5/1998 | Knowles et al. | 343/895 |
| 5,892,480 | 4/1999 | Killen | 343/895 |

*Primary Examiner*—Tan Ho
*Assistant Examiner*—Shih-Chao Chen
*Attorney, Agent, or Firm*—Allen, Dyer, Doppelt, Milbrath & Gilchrist, P.A.

[57] ABSTRACT

A broad beam helical antenna contains a monofilar winding of a constant helical diameter and large valued pitch angle. The diameter of the helical antenna is defined such that its circumference is slightly less than one wavelength of the circular polarized radio waves. The pitch angle lies in a relatively high range on the order of 18° to 24°. These parameters provide a generally uniform gain over a relatively wide beam angle on the order of 60° off boresight. Such gain-uniformity facilitates maintaining a link between a satellite and mobile platform-mounted communication equipment.

6 Claims, 1 Drawing Sheet

$$\Pi D = 0.75\text{-}0.95\Lambda$$

$$\tan^{-1}\alpha = \frac{S}{\Pi D}$$

$$\alpha = 18^\circ - 24^\circ$$

$\Pi D = 0.75\text{-}0.95\Lambda$ $\tan^{-1} \alpha = \frac{S}{\Pi D}$ $\alpha = 18^\circ - 24^\circ$

BROAD BEAM MONOFILAR HELICAL ANTENNA FOR CIRCULARLY POLARIZED RADIO WAVES

FIELD OF THE INVENTION

The present invention relates in general to communication systems, and is particularly directed to a new and improved broad beam helical antenna configuration having a monofilar winding of a constant helical diameter and prescribed pitch angle. The diameter of the helical antenna is defined such that the monofilar winding has a circumference less than one wavelength of the circular polarized radio waves (RF signals) it is intended to transmit/receive; the pitch angle lies in a range on the order of 18° to 24°. These parameters are effective to provide a generally uniform gain over a relatively wide beam angle on the order of 60° off boresight. Such gain-uniformity is especially desirable for maintaining a link between a satellite and mobile platform-mounted communication equipment.

BACKGROUND OF THE INVENTION

In order to conduct communications with a satellite, the location of which can be expected to vary (sometimes very substantially) relative to a (mobile) platform's antenna boresight axis, reduced hardware complexity communication platforms often employ helical antennas, such as the monofilar winding structure, diagrammatically shown at 10 in FIG. 1. Although the reduced complexity of a conventional monofilar antenna makes it a relatively inexpensive structure, it's radiation pattern is concentrated along the (boresight) axis 12 of the helical winding; as a result, the pattern cannot be effectively scanned, so that it has limited phased array utility.

In order to maintain communication connectivity with a satellite, it is preferred that antennas not only be capable of being scanned, but have proper polarization. Where circular polarization is desired, the helical antenna has been typically configured as a multi-winding structure, as diagrammatically illustrated in FIG. 2, comprised of a plurality of concentrically arranged helical windings 13, each having a fractional number of turns, and terminating the respective windings to a multi-quadrature port hybrid interface 14.

A drawback to this conventional multi-winding architecture is the cost and hardware complexity of the combination of the antenna proper and its electronic interface. For the conventional monofilar structure shown in FIG. 1, the gain pattern 20 of such an antenna exhibits a substantial lobe along and in the close vicinity of the boresight axis 12, making the antenna effectively an 'axial mode' device. As a result, it is not well suited for wide beam coverage, particularly since increasing the number of turns of each winding in order to enhance its circular polarization characteristics also increases the gain of the helical winding along its longitudinal (boresight) axis.

SUMMARY OF THE INVENTION

Pursuant to the present invention, such shortcomings of conventional monofilar and multi-winding helical antenna architectures are effectively obviated by configuring the antenna as a multi-turn monofilar helix having a constant diameter along its axis, and a prescribed pitch angle that is effective to maintain a generally uniform antenna gain for circularly polarized radio waves over a relatively wide spatial volume. This allows the antenna to operate over a substantial off-axis look angle, and thereby makes the antenna a scannable device, so that it may be readily employed in phased array applications.

By generally uniform antenna gain is meant an antenna gain that exhibits a relatively small slope (in terms of dB vs. change in off-axis look angle coverage) over a substantial angular direction relative to the longitudinal axis. As a non-limiting example, a pitch angle lying in a range in the order to 18° to 24° has been demonstrated to maintain gain well within several dB of boresight gain over a beam angle coverage on the order of 60° off boresight.

The absolute magnitude of boresight gain of the monofilar helix of the invention is reduced compared to that of a conventional helical structure, which has a much smaller pitch angle (typically on the order of 12° to 14°). However, obtaining wide beam circular polarization coverage by means of a reduced cost/complexity structure constitutes a very acceptable trade-off to the reduction in boresight gain.

DETAILED DESCRIPTION

Figure 1:
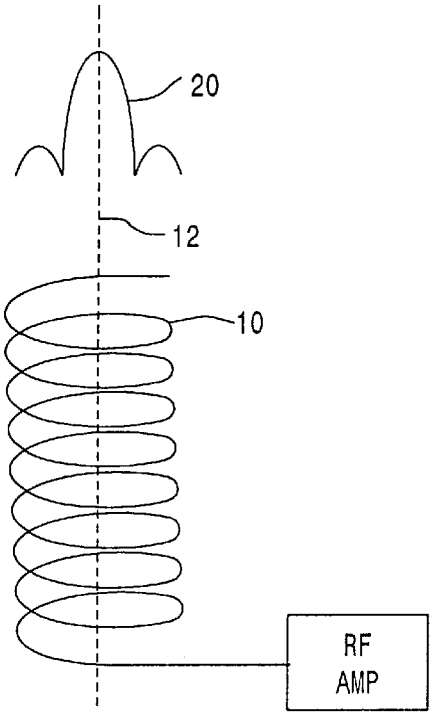
FIG. 1 PRIOR ART
FIG. 1 shows a conventional monofilar axial mode helical antenna and its associated gain characteristic.
Figure 2:
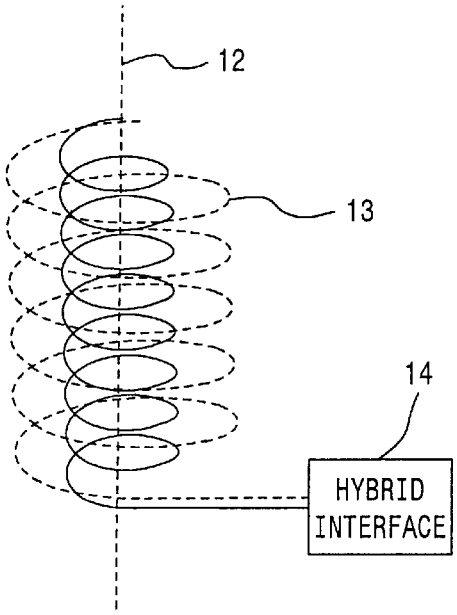
FIG. 2 PRIOR ART
FIG. 2 shows a multiwinding axial mode helical antenna.
Figure 3:
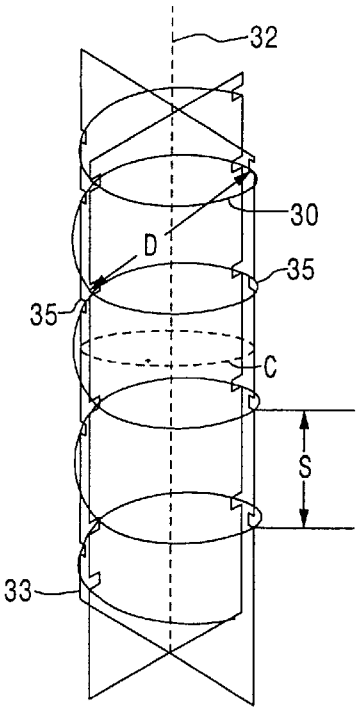
FIG. 3 diagrammatically illustrates the architecture of a broad beam, mono-filar helical antenna in accordance with the present invention.

FIG. 3 diagrammatically illustrates the architecture of a broad beam monofilar helical antenna configuration in accordance with a non-limiting embodiment of the invention. The antenna is formed by winding a single conductor winding 30 along a helical path, having constant helical diameter D and a prescribed pitch angle a along the longitudinal or boresight axis 32 of the helix. For this purpose, the conductor 30 may be formed upon a conventional periodically slotted cross-support structure 33 made of low dielectric material, or other conventional coil forming arrangements commonly employed in the technology for constructing and supporting multi-turn windings and coils. In the structure of FIG. 3, the spacing S between the slots 35 in the cross-support structure 33 is defined in accordance with standard radio communication engineering practice, so that the arctangent of the antenna's pitch angle $\alpha$ equals the ratio of the periodic spatial separation S between immediately successive turns of the winding to $\pi D$.

As described briefly above, the diameter D of the monofilar helix 30 is defined such that the circumference C of the helical winding is less than one wavelength of the circularly polarized radio waves the antenna is intended to interface (transmit and/or receive). In accordance with a non-limiting, but preferred embodiment of the invention, the value of diameter D may be defined such that the circumference C of the monofilar helix 30 is on the order of 0.75 to 0.95 of one wavelength ($\lambda$) of circularly polarized radio waves.

In addition, the pitch angle $\alpha$ the winding 30 is maintained at a constant value along its axial length that falls within a pitch angle range of increased pitch angle values that are effective to maintain a generally uniform antenna gain for circularly polarized radio waves over a relatively wide spatial volume. Analysis of the performance of the monofilar helical antenna of the invention for a 60° circularly polarized wave over a relatively wide beam angle on the order of 60° off the boresight axis are tabulated in Table 1 below.

As shown therein, increasing the pitch angle $\alpha$ of a monofilar helical winding, from the relatively low valued range of 12°–14° used for conventional (non-scannable) helical antennas to a much higher value that lies within a pitch angle range on the order of 18° to 24°, is effective to provide a generally uniform gain (on the order of 5–6 dBiC) over a fifteen percent range of frequency variation.

TABLE 1

| No. Turns | α° | C(λ) | wire diam. (λ) | gain (dBiC) |
|---|---|---|---|---|
| 3 | 19 | 0.95 | 0.02 | 4.815 |
| 3.5 | 19.5 | 0.85 | 0.01 | 4.888 |
| 4 | 23.5 | 0.75 | 0.02 | 5.276 |
| 4.5 | 20.5 | 0.85 | 0.02 | 5.483 |
| 5 | 21.5 | 0.8 | 0.02 | 5.535 |
| 5.5 | 18 | 0.9 | 0.01 | 5.82 |
| 6 | 20.5 | 0.85 | 0.02 | 5.677 |
| 6.5 | 20.5 | 0.85 | 0.02 | 5.846 |
| 7 | 18.5 | 0.9 | 0.01 | 5.848 |
| 7.5 | 18.5 | 0.9 | 0.01 | 6.0 |
| 8.1 | 18.5 | 0.9 | 0.01 | 5.808 |
| 8.7 | 18.5 | 0.9 | 0.01 | 5.913 |
| 9.3 | 18.5 | 0.9 | 0.01 | 5.924 |
| 9.9 | 21 | 0.85 | 0.02 | 5.859 |
| 10.5 | 21 | 0.85 | 0.02 | 6.028 |

As pointed out above, such wide angle gain-uniformity facilitates maintaining a communication link between a satellite and mobile platform-mounted equipment, the orientation of which can be expected to be dynamic. While the absolute magnitude of boresight gain of the monofilar helix of the invention is reduced compared to that of a conventional multifilar winding structure having a much smaller pitch angle on the order of 12° to 14°, the invention's ability to provide wide beam circular polarization coverage by means of a reduced cost and complexity structure constitutes a very acceptable trade-off. This is especially important in a mobile platform communication system, where a link with a satellite must be maintained irrespective of the often dynamic orientation of the terrestrial platform. The relatively compact size and reduced complexity of the helical antenna of the invention makes it readily applicable to a variety of dynamic communication systems, such as but not limited to shipborne and airborne phased array platforms.

While I have shown and described an embodiment in accordance with the present invention, it is to be understood that the same is not limited thereto but is susceptible to numerous changes and modifications as known to a person skilled in the art, and I do not therefore wish to be limited to the details shown and described herein, but intend to cover all such changes and modifications as are obvious to one of ordinary skill in the art.

What is claimed:

1. A method of providing broad beam antenna coverage for circularly polarized radio waves comprising the steps of:

(a) generating an RF signal;

(b) coupling said RF signal to a multiturn helical antenna having an axial length along an axis thereof, and being formed of no more than a single conductive winding of a constant helical diameter, and having the same prescribed pitch angle along the multiple turns of the axial length of said helical antenna, so as to stimulate said helical antenna to emit a circularly polarized radio wave; and wherein said prescribed pitch angle lies in a range of 18° to 24° so as to maintain a generally uniform antenna gain (for circularly polarized radio waves) having a maximum on said axis and extending therefrom over a spatial volume on the order of 60° off said axis.

2. The method according to claim 1, wherein said diameter is such that helical antenna has a circumference less than one wavelength of said circularly polarized radio waves.

3. The method according to claim 2, wherein said circumference is on the order of 0.75 to 0.95 of one wavelength of said circularly polarized radio waves.

4. A broad beam antenna architecture for circularly polarized radio waves comprising:

electrical terminals with which RF energy is interfaced; and a helically configured antenna coupled to said electrical terminals having multiple helical turns along an axial length thereof and formed of no more than a single conductive winding of a constant helical diameter along a longitudinal axis thereof, and having a constant pitch angle along said axial length of the multiple helical turns of said helically configured antenna that lies in a range of 18° to 24° and is effective to maintain a generally uniform antenna gain (for circularly polarized radio waves) having a maximum on said longitudinal axis and extending therefrom over a spatial volume the order of 60° off said longitudinal axis.

5. The broad beam antenna architecture according to claim 4, wherein said constant diameter is defined such that said winding has a circumference less than one wavelength of said circular polarized radio waves.

6. The broad beam antenna architecture according to claim 5, wherein said circumference is on the order of 0.75 to 0.95 of one wavelength of said circularly polarized radio waves.

* * * * *